US012127700B1

(12) United States Patent
Deschamps

(10) Patent No.: US 12,127,700 B1
(45) Date of Patent: Oct. 29, 2024

(54) MAXIMUM COMFORT HYBRID SLEEPING AND RESTING PILLOW

(71) Applicant: Chris L. Deschamps, Phoenix, AZ (US)

(72) Inventor: Chris L. Deschamps, Phoenix, AZ (US)

( * ) Notice: Subject to any disclaimer, the term of this patent is extended or adjusted under 35 U.S.C. 154(b) by 0 days.

(21) Appl. No.: 18/736,243

(22) Filed: Jun. 6, 2024

Related U.S. Application Data

(60) Provisional application No. 63/471,504, filed on Jun. 7, 2023.

(51) Int. Cl.
*A47G 9/10* (2006.01)

(52) U.S. Cl.
CPC ..... *A47G 9/109* (2013.01); *A47G 2009/1018* (2013.01)

(58) Field of Classification Search
CPC ..... A47G 9/0253; A47G 9/10; A47G 2009/1018; A47G 9/1081; A47G 9/109; A47C 20/02
See application file for complete search history.

(56) References Cited

U.S. PATENT DOCUMENTS 1,020,444 A * 3/1912 Platt ..... A47G 9/10 5/636
1,385,355 A * 7/1921 Banks ..... A47G 9/109 5/636
2,765,480 A * 10/1956 Mueller ..... A47C 7/425 5/636
2,940,087 A * 6/1960 Kiefer ..... A47G 9/10 5/636
3,305,878 A * 2/1967 Hellbaum ..... A47C 27/146 5/653
3,308,489 A * 3/1967 Winkler ..... A61G 7/0755 5/644
3,411,164 A * 11/1968 Sumergrade ..... A47G 9/10 5/644
4,007,503 A * 2/1977 Watkin ..... A47G 9/10 5/490
4,118,813 A * 10/1978 Armstrong ..... A47G 9/10 5/636

(Continued)

FOREIGN PATENT DOCUMENTS

CN 208892155 U * 5/2019 ..... A47G 9/1081
CN 110613285 A * 12/2019

(Continued)

*Primary Examiner* — Eric J Kurilla
(74) *Attorney, Agent, or Firm* — Bycer & Marion, PLC; Matthew L. Bycer

(57) ABSTRACT

A tri-sectional pillow including a central headbed set between two bolster sections on opposing ends. The headbed is preferably rectangular in shape with the bolsters being taller and rounded. The bolsters are conical in shape, including wide or tall sides set on opposing ends of the pillow. One bolster being larger than the other, the smallest portion of the large bolster being of the same size/diameter as the larger end of the smaller booster. The template of the fabric case to enclose the headbed and bolsters is a parallelogram, with the bolster sections being abnormal trapezoids. A booster may be set below the tri-sectional pillow, and may be set within a special pillow case that can enclose the tri-sectional pillow above the booster pillow.

11 Claims, 13 Drawing Sheets

(56) References Cited

U.S. PATENT DOCUMENTS 5,038,432 A * 8/1991 Robillard ..... A47G 9/10 5/645
5,214,814 A * 6/1993 Eremita ..... A47G 9/109 5/636
5,237,714 A * 8/1993 Baron ..... A47G 9/10 5/636
5,367,731 A * 11/1994 O'Sullivan ..... A61F 7/02 5/636
5,661,862 A * 9/1997 Ryndak ..... A47G 9/10 5/636
5,940,913 A * 8/1999 Horowitz ..... A47G 9/1081 5/636
5,987,676 A * 11/1999 Littleford ..... A47G 9/10 5/636
6,513,179 B1 * 2/2003 Pan ..... A47G 9/109 5/636
6,641,220 B2 * 11/2003 Clegg ..... A47C 7/383 5/636
6,671,906 B1 * 1/2004 Milligan ..... A47G 9/10 5/636
6,817,049 B1 * 11/2004 Hall ..... A47G 9/109 5/636
6,981,288 B1 * 1/2006 Hu ..... A47G 9/10 5/636
7,089,615 B1 * 8/2006 Parimuha ..... A47G 9/10 5/636
7,562,405 B2 * 7/2009 Brogan ..... A47G 9/10 5/636
7,681,263 B1 * 3/2010 Hawkins ..... A47G 9/10 5/640
7,975,336 B1 * 7/2011 Perry ..... A47C 27/086 5/636
10,383,466 B2 * 8/2019 Wilmarth ..... A47C 20/025
10,448,764 B2 * 10/2019 Aydemir ..... A47G 9/1009
11,627,821 B2 * 4/2023 Noble ..... A47G 9/109 5/640
2005/0076443 A1 * 4/2005 Kruger ..... A47G 9/1081 5/636
2006/0123547 A1 * 6/2006 Ferber ..... A47G 9/10 5/636
2008/0028528 A1 * 2/2008 Wilson ..... A61F 5/01 5/636
2008/0086819 A1 * 4/2008 Valero Pavia ..... A47G 9/10 5/636
2008/0134438 A1 * 6/2008 Park ..... A47G 9/10 5/636
2008/0282474 A1 * 11/2008 Hsin ..... A47G 9/10 5/636
2011/0094034 A1 * 4/2011 Cortright ..... A47G 9/1081 5/636
2013/0031723 A1 * 2/2013 Parnham ..... A47G 9/1081 5/645
2016/0213176 A1 * 7/2016 Clemente, II ..... A47G 9/1081
2023/0414017 A1 * 12/2023 Gandhi ..... A47G 9/1081

FOREIGN PATENT DOCUMENTS

CN 111802879 A * 10/2020
KR 20110001564 U * 2/2011
KR 200454313 Y1 * 6/2011
KR 101964684 B1 * 8/2019
KR 102598661 B1 * 11/2023
KR 102683971 B1 * 7/2024
WO WO-0238013 A2 * 5/2002 ..... A47G 9/10

* cited by examiner

MAXIMUM COMFORT HYBRID SLEEPING AND RESTING PILLOW

CLAIM OF PRIORITY

The present application includes subject matter disclosed in and claims priority to U.S. provisional patent application entitled "Maximum Comfort Hybrid Sleeping and Resting Pillow" filed Jun. 7, 2023, and assigned Ser. No. 63/471,504, incorporated herein by reference, and which describes an invention made by the present inventor.

BACKGROUND OF THE INVENTION

1. Field of the Invention

The present invention relates generally to a cushioned support for a person's head, neck, and in some embodiments body, and more specifically, but not exclusively, to a pillow, such as a pillow used for sleep, rest, comfort, or therapeutic purposes.

2. Description of Related Prior Art

Sleeping and resting pillows are traditionally rectangular in shape, constructed by overlaying and attaching two identical rectangular pieces of fabric. The space between the overlaid faces is typically filled with a soft, uniform filling which produces a gently curved surface on each rectangular face. Such pillows are not designed to match the contours of the human body, nor do they provide support and comfort for the head, neck, and back in all sleep positions.

Pillows designed for lateral sleepers are generally taller to support the larger distance between the head and the surface they are laying on. These pillows are nearly impossible for a prone sleeper to use, and generally suboptimal for supine sleepers due to their excessive height. Other pillows are designed in various ergonomic configurations to support the natural curvature of the head, neck, and spine. For example, some ergonomic pillows are designed as a single solid structure, with a higher portion for neck support, and a lower portion for head support, mimicking the natural curvature of the head and neck when lying in the lateral position. Such pillows are suboptimal for supine or prone sleepers due to their excessive height. Ideal pillows for those who sleep in the supine position are relatively flat pillows that provide support for the neck without propping the head too high. Pillows designed for those sleeping in the supine position might be slightly inclined in the neck region, but not as inclined as those designed for individuals lying in the lateral position. Additionally, traditional ergonomic pillows are suboptimal for those who sleep in the prone position, as an ideal pillow for prone sleeping is a less elevated pillow that reduces strain on one's neck.

While different pillows may be ideal for various sleeping positions, many people do not sleep in the same position from night to night, or even throughout a single night. Therefore, even the most ergonomic, comfortable pillow may be lacking when a user rolls from the lateral position to a prone position in the middle of the night, and may not be suitable for more active sleepers. Particularly, in hotels, furnished rentals, and other such accommodations that frequently host visitors, pillows currently known in the art cannot universally satisfy all guests.

Similarly, as sleeping positions vary, user size and body build also vary. While most pillows currently known in the art are designed to fit a broad variety of users, some are designed to fit specific sizes and body types. However, even these specifically designed pillows cannot accommodate multiple users of various sizes, making them unsuitable for every individual, or in rental accommodations, as mentioned above. There is a great need for a more hybrid pillow that can be adapted to add comfort and support the sleep position, size, and body type of multiple users, as well as one that can accommodate the various sleep positions a single user may shift into throughout sleep. It is therefore an object of the present invention to provide a pillow that caters to most users, including those with extended needs. The use of an optional booster cushion may also help accommodate extreme needs of customers who require more lift in a head rest.

SUMMARY OF THE INVENTION

The present invention includes a three-sectioned pillow, the three sections being a flat central headrest section, with the flat central headrest section being bordered on a first side by a first rounded side section, and on a second side, opposite said first side, by a second rounded side section. The flat central headrest section may be a central rectangular prism. The pillow may include a pair of risers, such that the risers are elongated fabric walls, a first riser may be set along the first side between and adjacent to the flat central headrest section and the first rounded side section. A second riser may be set between and adjacent to the second side between and adjacent to the flat central headrest section and the second rounded side section.

The central headrest section may include a fastener set through at least one of the risers to secure the position of the central rectangular prism relative to the three-sectioned pillow. The central rectangular prism may have at least one wedged end to affix the wedged end to a casing of the three-sectioned pillow.

The two rounded side sections may be filled with a shredded loose material. The shredded loose material may be eighty percent shredded memory foam, plus or minus five percent, and twenty percent polyester fibers, plus or minus five percent. The two first and second rounded side sections may be conical or frustrum in shape. The first side section may be sloped, having a less elevated end with a first smaller diameter and a more elevated end with a first larger diameter. The second side section may also be sloped having a second less elevated end with a second small diameter, and a second more elevated end which is larger than the first large diameter. The second less elevated end and first more elevated end may be identical in size, or within one half inch of one another.

The pillow may be fashioned from a parallelogram fabric pillow template, the fabric pillow template may be constructed from a frame, wherein the parallelogram fabric pillow template includes at least three compartments separated by two interior vertical fabric risers. The parallelogram fabric pillow template may include a central section, flanked by two side sections. The central section may be rectangular in shape, and formed from a pair of identically shaped rectangular panels coupled to a pair of risers, the risers being long rectangular walls set on opposing sides of the rectangular panels. The risers may separate the central section from the two side sections.

The two side sections may be identically-shaped trapezoidal panels. The first of the pair of identically-shaped trapezoidal panels may have a first smaller end and a first larger end, wherein the first smaller end faces opposite the first larger end. The second of the pair of identically-shaped trapezoidal panels may have a second larger end and a second smaller end, such that the second larger end faces opposite the second smaller end. The first larger end may be equal in length to the second smaller end.

The three-sectioned pillow may be encased in an at least dual compartmented fabric pillow case, the pillow case including a top pillow pocket for housing the three-sectioned pillow set above and adjacent to a lower booster pocket housing a booster.

BRIEF DESCRIPTION OF THE DRAWINGS

The present invention will be described with greater specificity and clarity with reference to the following drawings, in which.

DETAILED DESCRIPTION OF THE PREFERRED EMBODIMENTS

A hybrid pillow is herein described with multiple sections of varying heights, and multiple filling types, hybrid in one or both shape and materials. The figures referred to herein are derived from photographs, and therefore may contain lines and curves that follow the natural curvature of an assembled product, these lines and curves are solely illustrative in nature, and not intended to limit the scope of the present disclosure.

The hybrid pillow may be optimally used by users of all human sizes and body types in any sleeping position. In some embodiments, the pillow may be used by children. As described, each section may have unique dimensions, such that the pillow may be oriented in any direction, to accommodate various sleeping positions and the needs of multiple users.

The usefulness of the pillow herein described includes the multicompartment shape having an alternative fill with a mixed fill in the bolsters, such that the mixed fill is malleable, shiftable, and can be fluffed on the ends. The multicompartment shape preferably includes a center headrest, filled with a stable foam block that is more solid than the mixed fill that fills the bolsters. It is preferable that the center headrest be flat and less high (potentially provided an "ear-relief") that commonly known pillows, such that side sleepers may use the higher bolster as well as the center headrest to achieve "ear relief". In a preferred embodiment, the bolsters may be tapered, conical, or frustrum shaped to allow for various heights and choices of height depending on the portion of the pillow used to rest one's head. It is preferable that the bolsters be of varying size, with a larger bolster and smaller bolster, being set with a larger end of each bolster on opposite sides (cattycorner) one another. Preferably the system uses a unique hybrid design with a combination of solid memory foam (or similar) connected to a loose memory foam-polyester fiber mixture or composite (or similar). The loose-filled booster may provide superior comfort when compared to commonly known uniform solid memory foam pillows with an ergonomic design. Each bolster may include a tapered design, providing multiple heights to fine-tune and personalize the sleeping experience, additionally, the different size bolsters may accommodate multiple sleeping positions.

Figure 1:
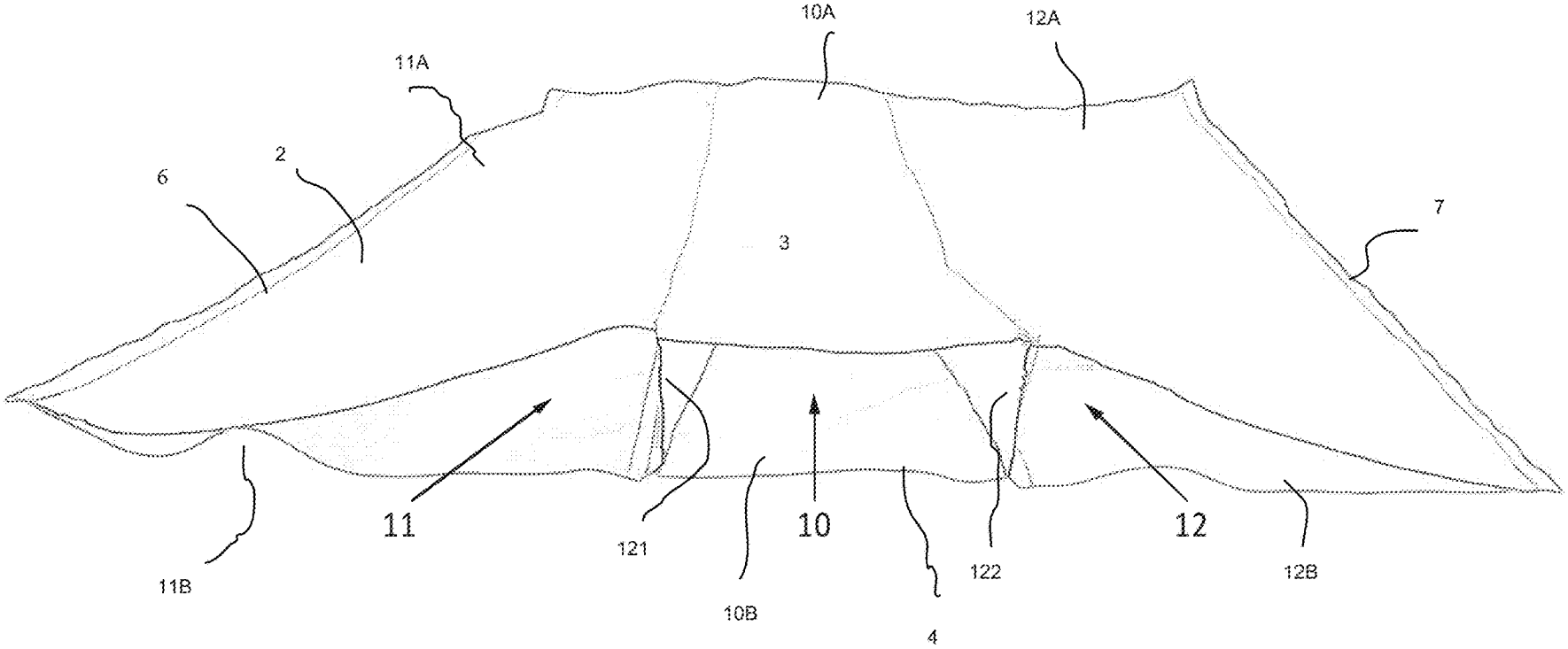
FIG. 1 is a front elevation view of a pillow's fabric case with compartments opened of an embodiment of the present invention.
Figure 2:
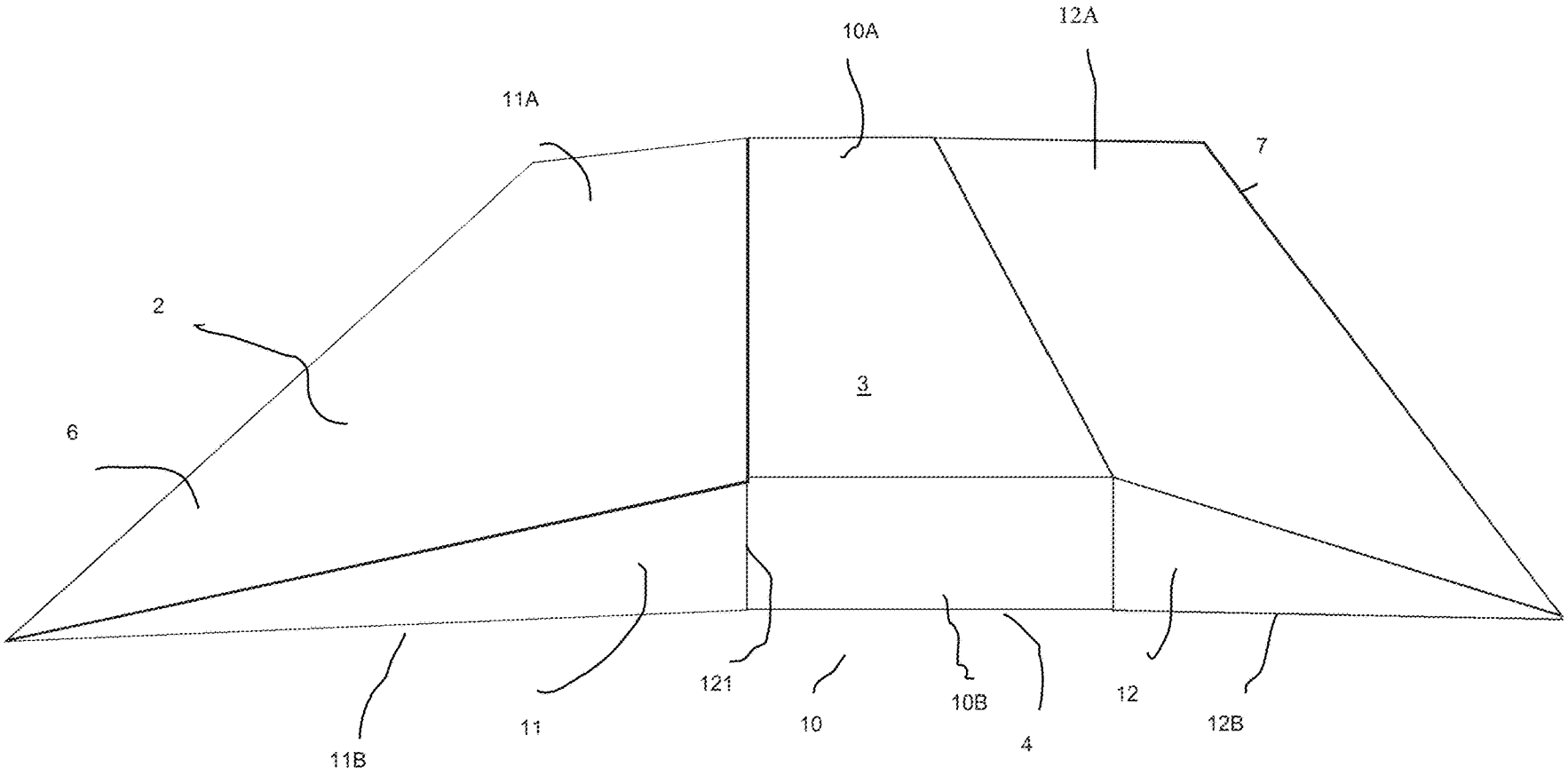
FIG. 2 is a front elevation view of a pillow's fabric case with compartments opened.
Figure 3:
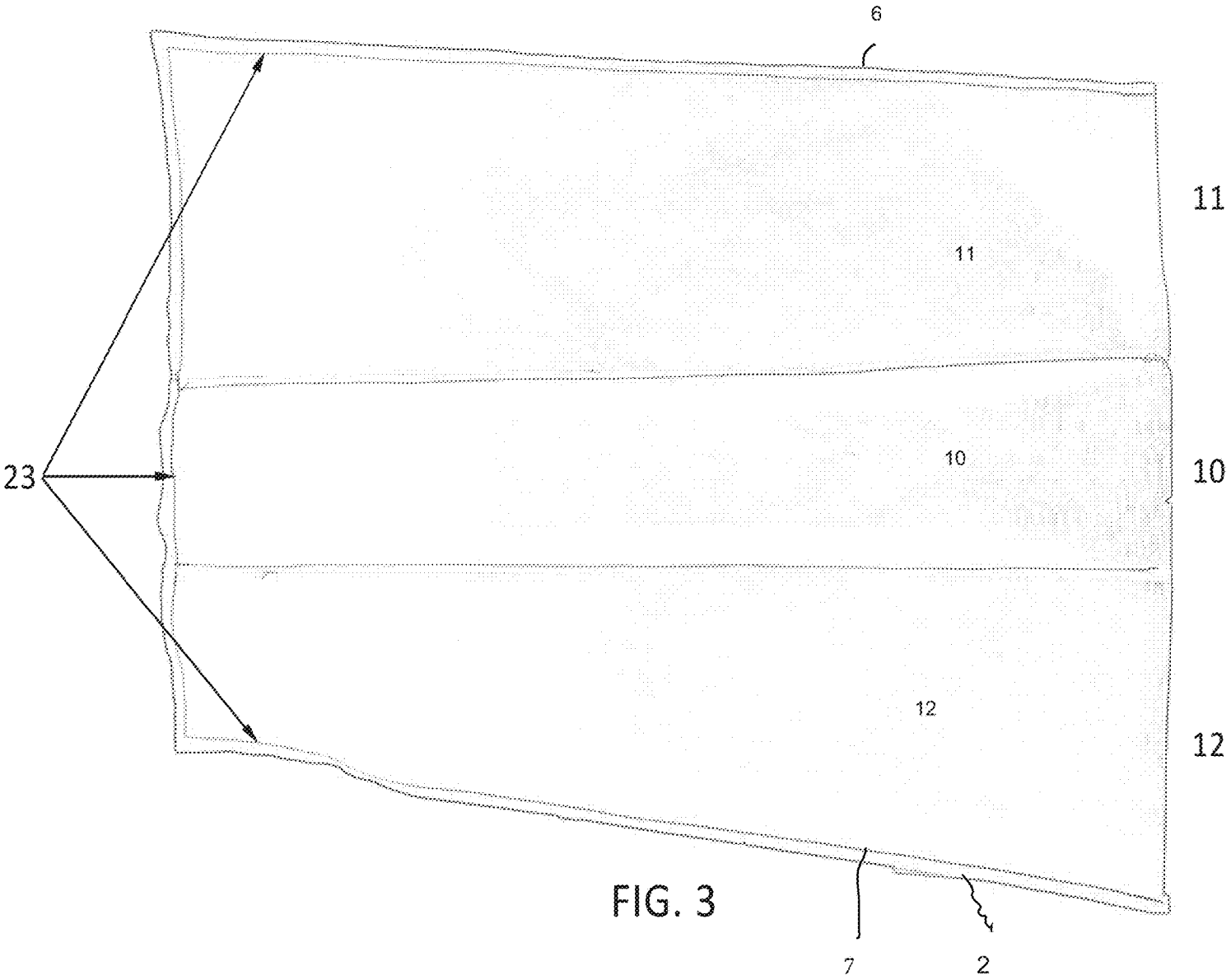
FIG. 3 is a top view of a pillow of an embodiment of the present invention.
Figure 4:
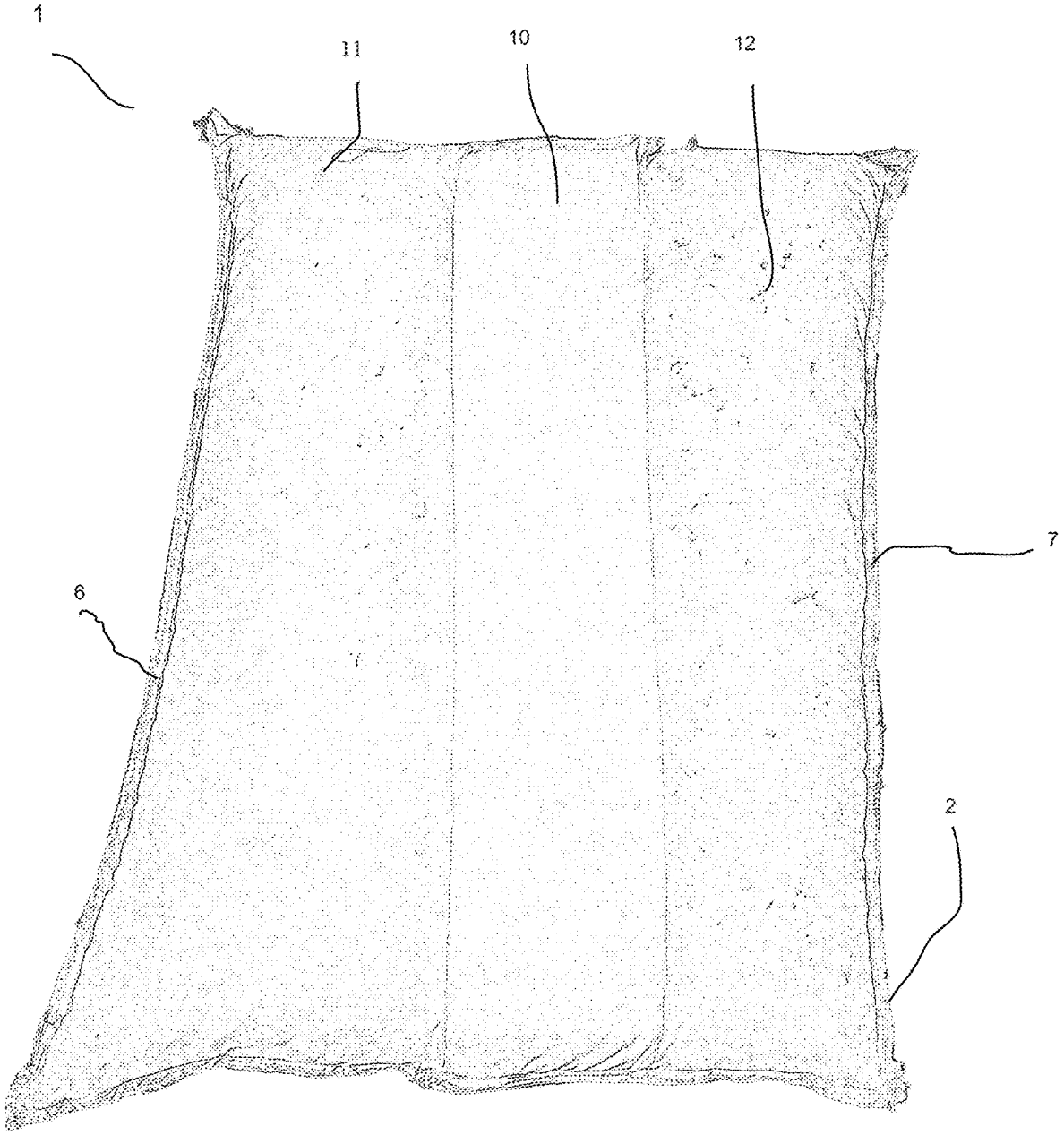
FIG. 4 is a top perspective top view of a filled pillow of an embodiment of the present invention.
Figure 5:
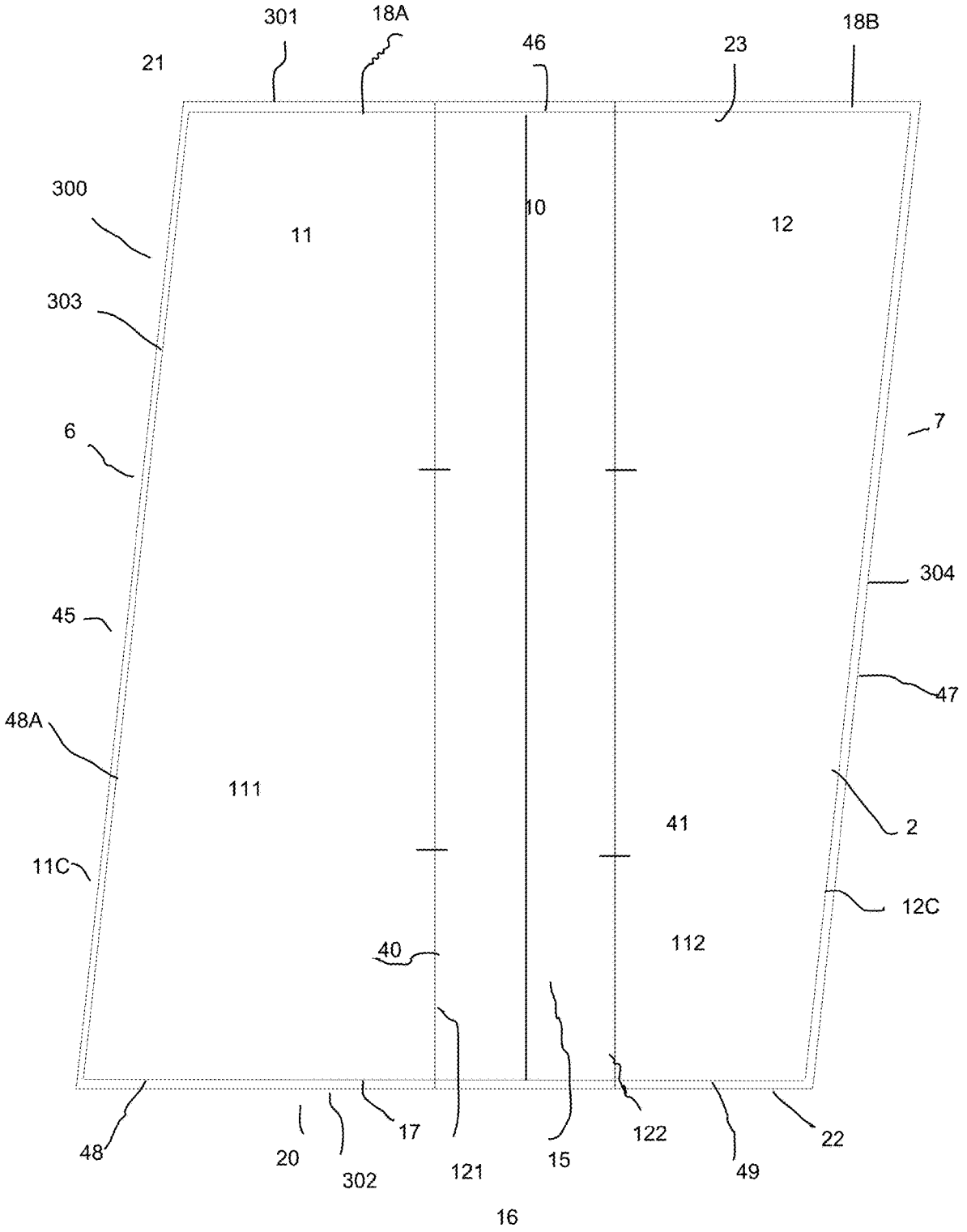
FIG. 5 is a top plan view of a pillow fabric template of an embodiment of the present invention.
Figure 6:
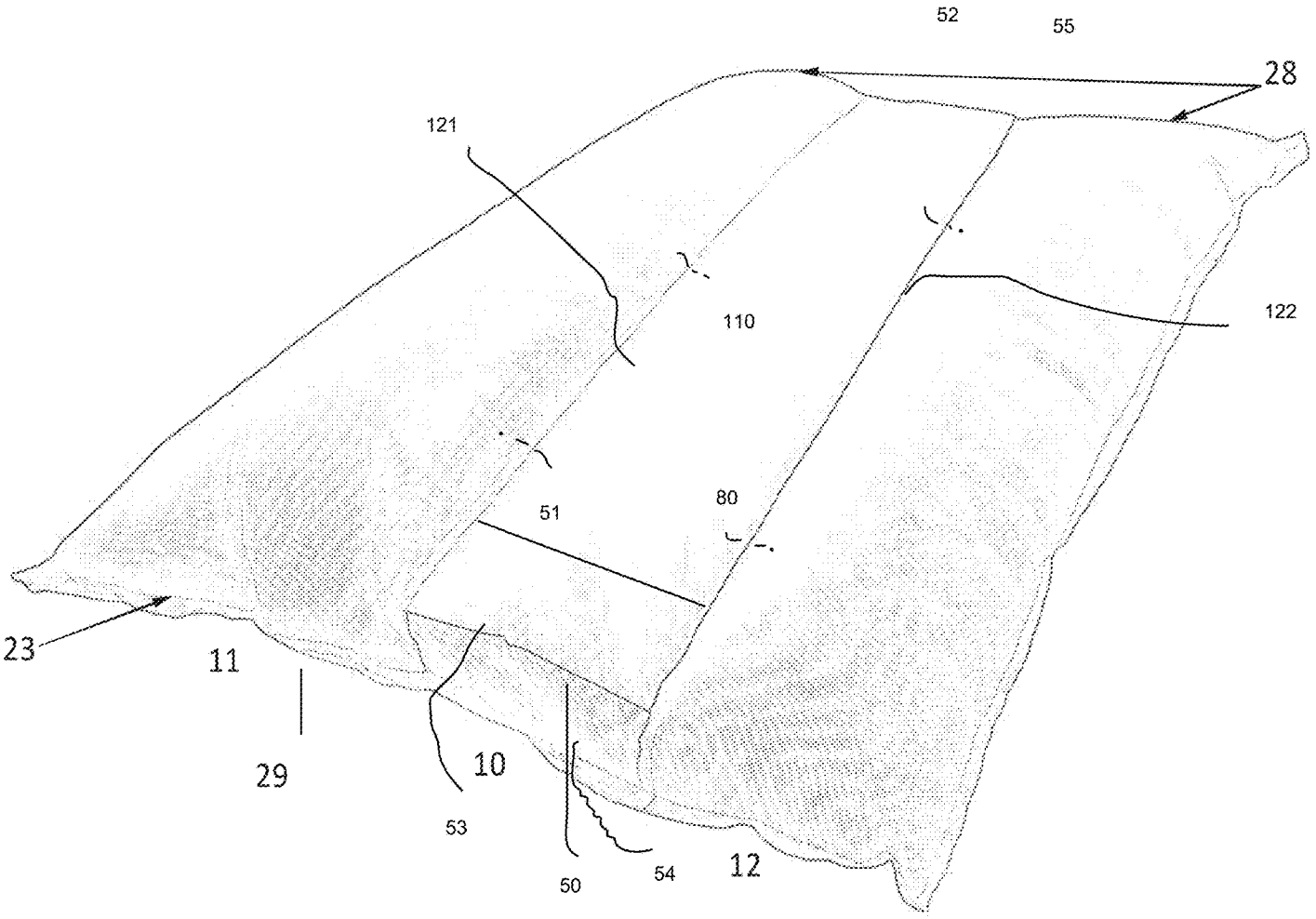
FIG. 6 is a front perspective view of a filled pillow of an embodiment of the present invention.
Figure 7:
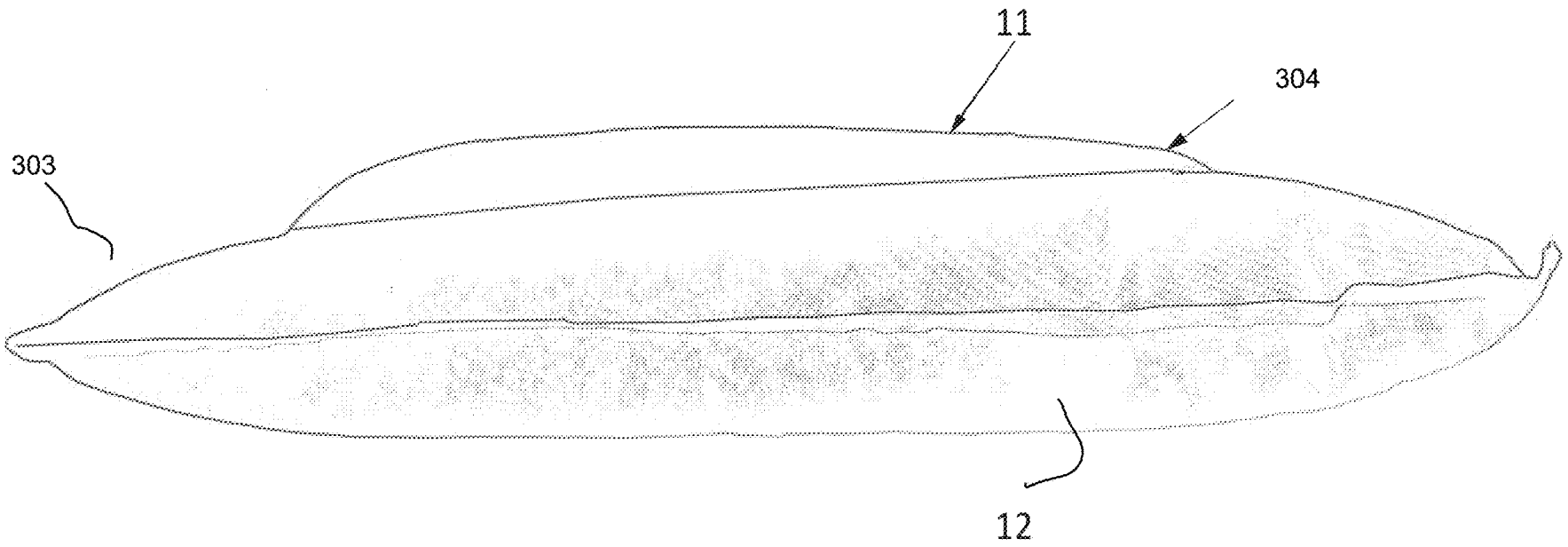
FIG. 7 is a side view of a filled pillow.
Figure 8:
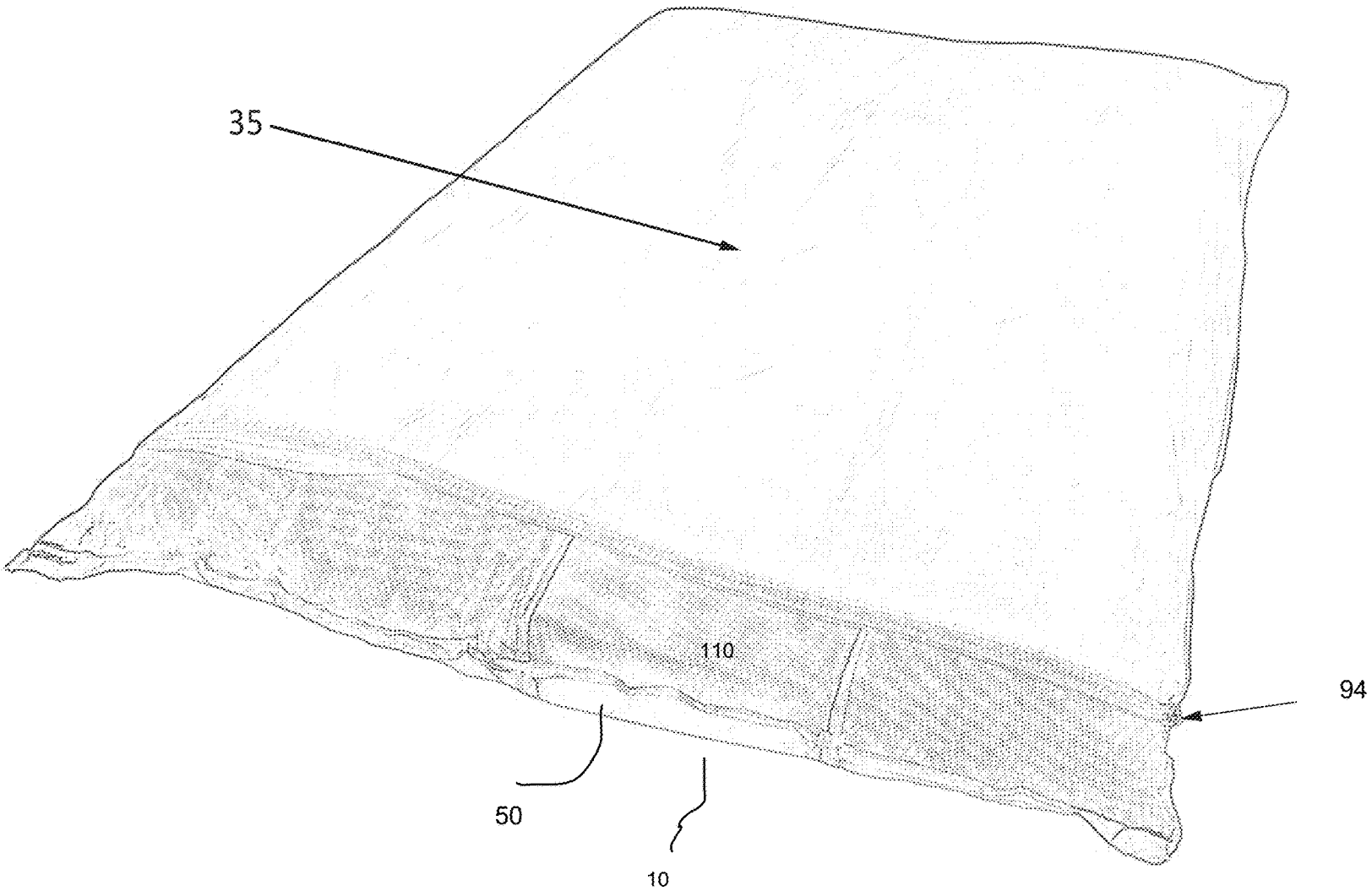
FIG. 8 an elevated front view of a filled pillow set within the pillow's outer cover.
Figure 9:
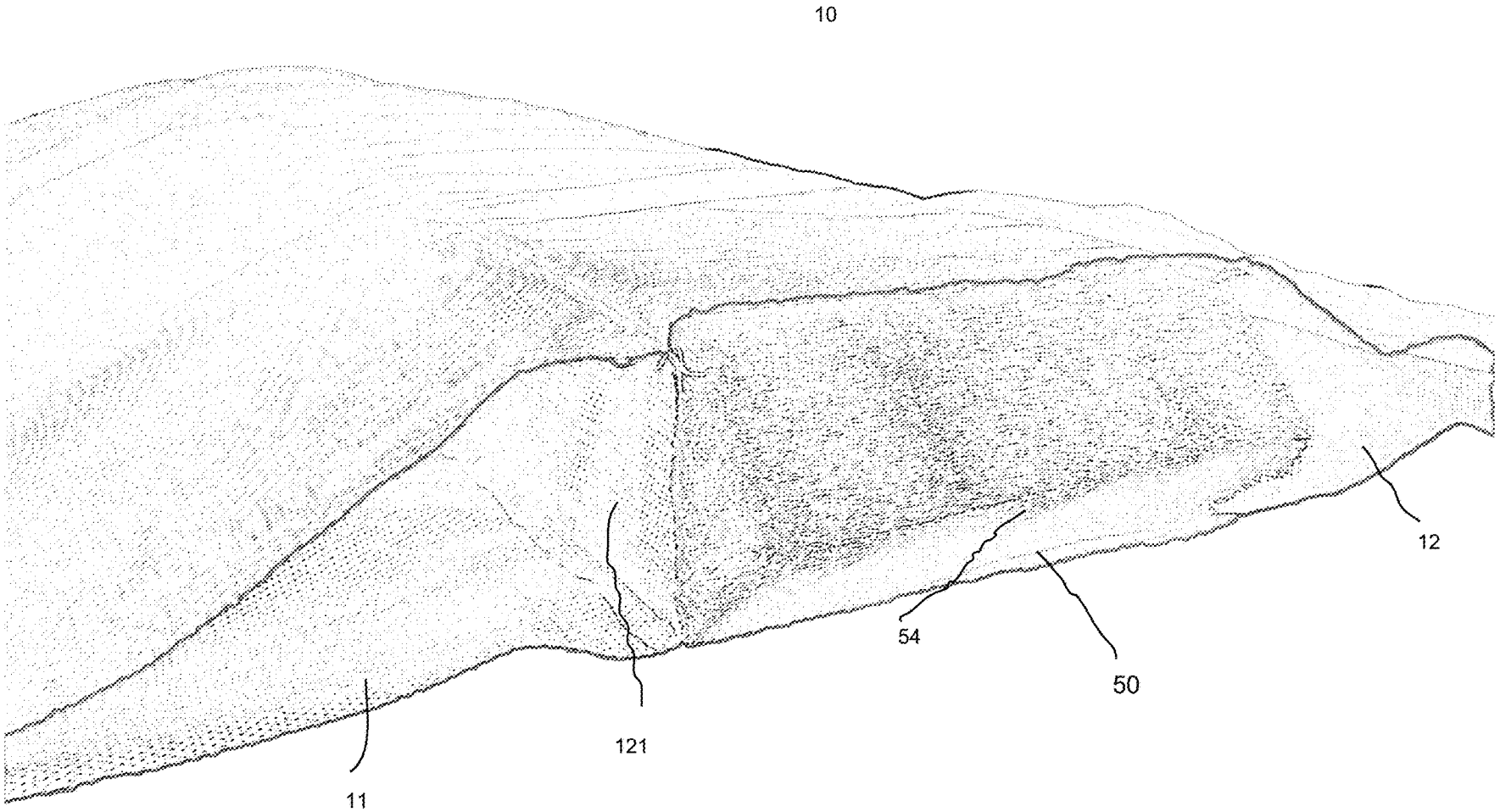
FIG. 9 is side perspective view of the fabric template with a single center filler piece installed as a memory foam block set within the pillow with a fastener.
Figure 10:
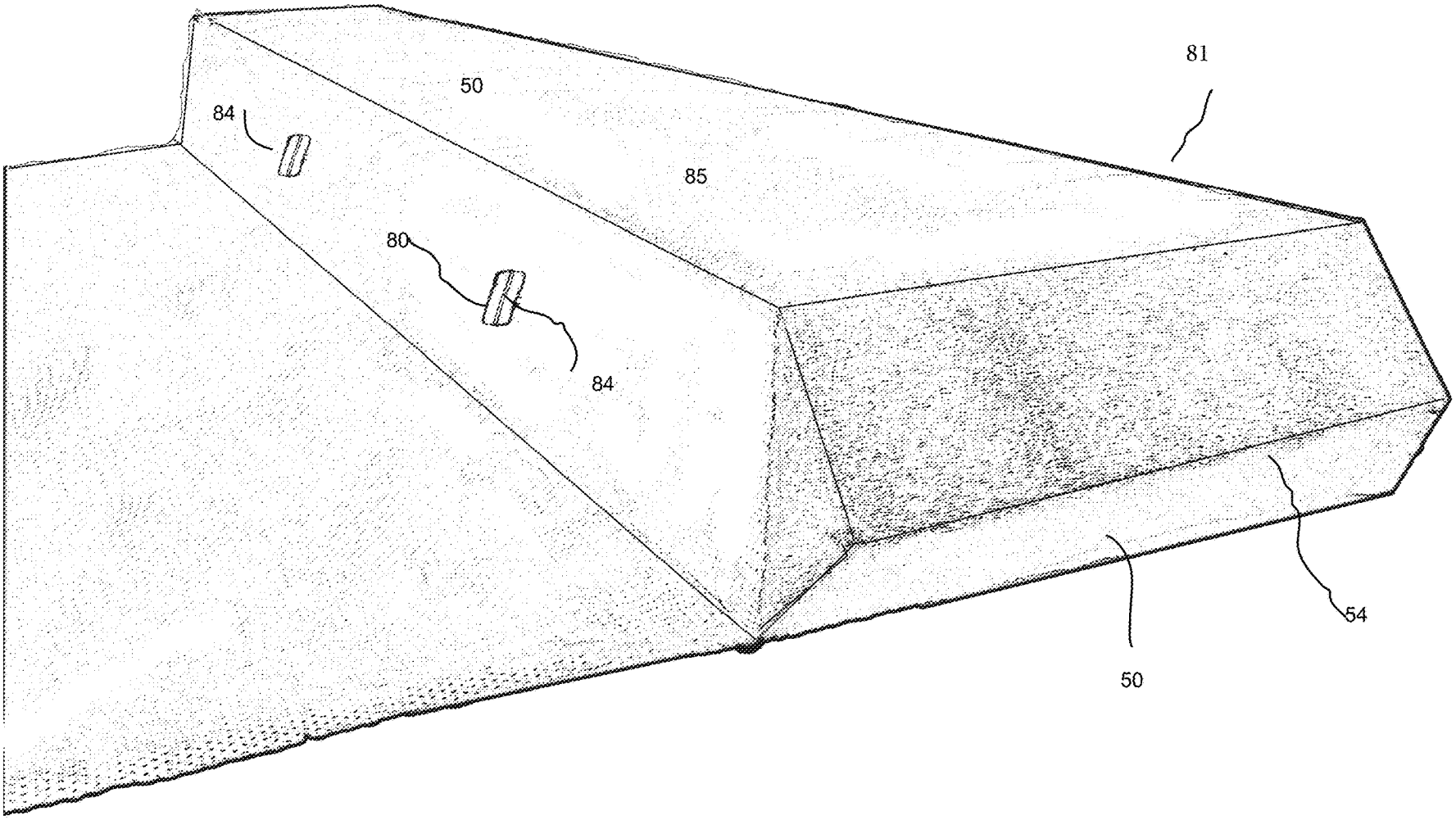
FIG. 10 is a side view of a riser in the central compartment with fastener installed.
Figure 11:
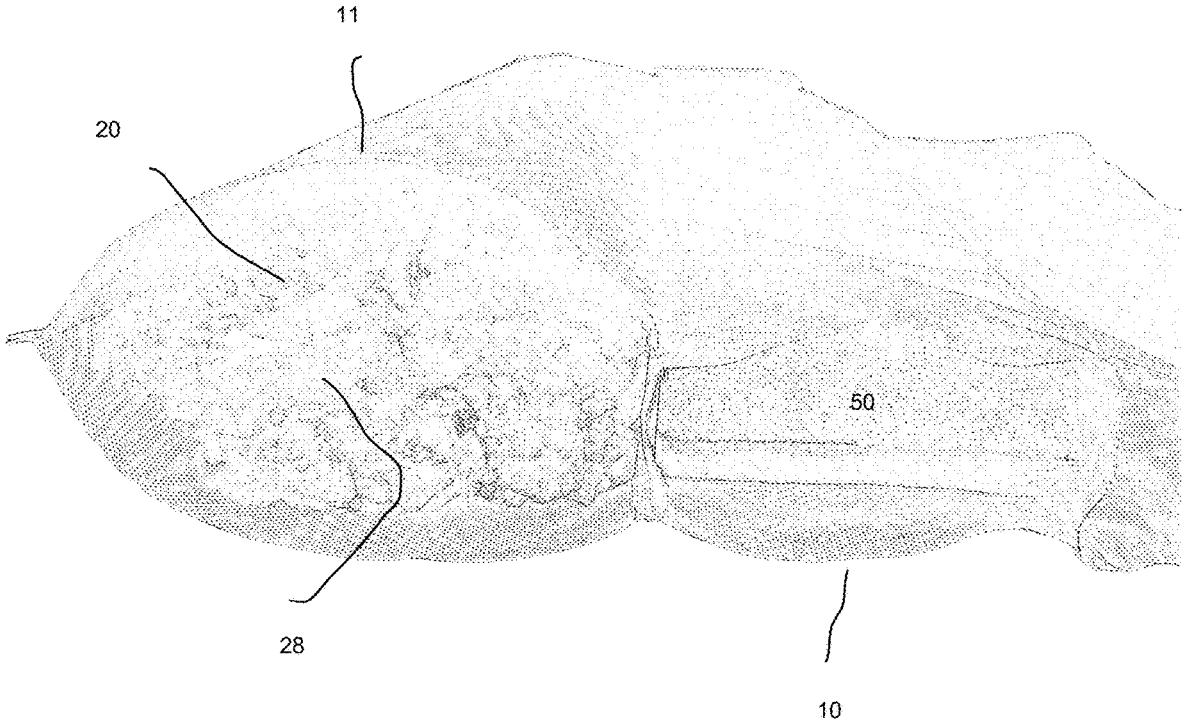
FIG. 11 is a partial cross-sectional front view of a pillow with filing exposed.
Figure 12:
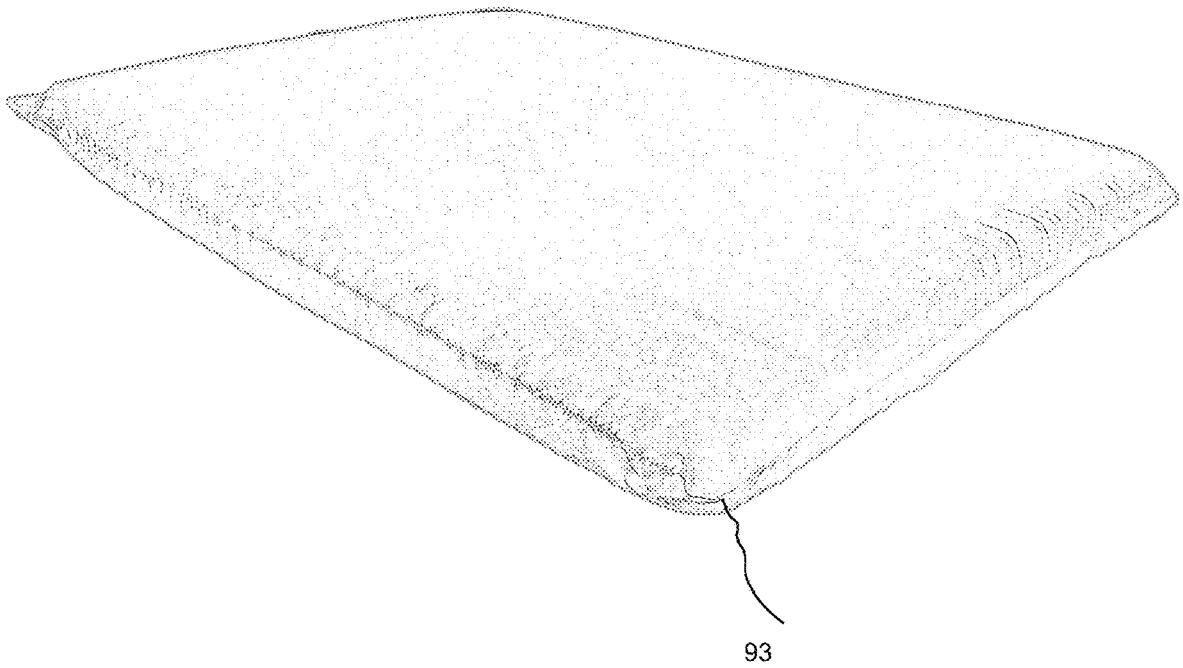
FIG. 12 is a perspective view of the booster cushion.
Figure 13:
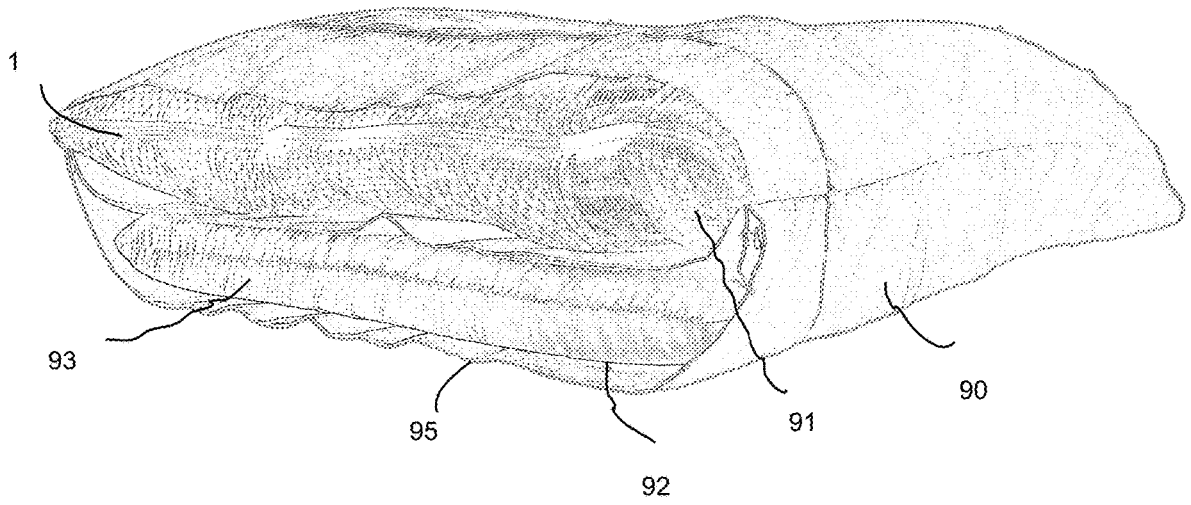
FIG. 13 is a front perspective view of the booster unit installed in a special case of pillow plus booster of an alternative embodiment of the present invention.

FIGS. 1 and 2 show a front elevation view of a fabric frame 2 useful for inserting filling to produce pillow 1 (as seen in FIG. 4). FIGS. 3-5 are top views showing the fabric frame 2 with (FIG. 4) and without fill to demonstrate the shape of the fabric template. FIG. 6 provides a top view of the filled pillow 1. FIG. 7 shows the right-side view demonstrating the conical tapered right bolster unit 12 in front 303, the larger left bolster unit 11 in rear 304, demonstrating the conical and tapered shape of each being pointed in opposite directions. FIG. 8 shows the pillow frame being placed into a pillowcase 35. FIG. 9 shows a front section with the center headrest block having a tapered/pointed end 54, such that tapered end 54 may be affixed to fabric frame 2 (not shown in FIG. 9) to fix position of foam block in pillow fabric frame 2. FIG. 10 shows a fastener 84 passing through riser 121 such that faster 84 coupled riser 121 to foam block 50. FIG. 11 demonstrates the difference in fill as between the chopped, mixed fill in bolster 11 as compared to the block 50 in center headrest 10. FIG. 12 shows a booster cushion useful in the combined alternative use shown in FIG. 12 with booster cushion set below pillow in a special combined case.

As seen in FIG. 1, the hybrid pillow may be constructed from fabric frame 2, such that fabric frame 2 may be a (set of) parallelograms, divided into three separate sections, each of the sections being an enclosed compartment with a first panel set over a second panel to form a compartment. Two identical full panels may be cut and then placed upon one another, or a single sheet may be folded over, such that the long (angled) ends are enclosed/sealed. Ends may remain open for filling, to be closed thereafter. In a preferred embodiment, the three sections may include compartments for two side bolsters (left-side bolster 11 and right-side bolster 12), and a compartment for a central headrest 10 set in the center between left-side bolster 11 and right-side bolster 12 (when viewed from above as shown in FIG. 1). In a preferred embodiment, before fabric frame 2 is filled with padding or pillow material, left side bolster 11 and right-side bolster may be constructed in a trapezoidal shape, as in two trapezoidal panels formed over one another, such that after left-side bolster 11 and right-side bolster 12 are filled, the bolsters (11 and 12) may be sloped, and conical or frustrum in shape. In a preferred embodiment, the compartment for central headrest 10 may be rectangular in shape with the long sides sealed and adjacent to the bolster sections. These long sides of the central section may include riser walls (121 and 122) to separate from the side bolster sections. In some embodiments, when prepared for use, left-side bolster 11 and right-side bolster 12 may be filled with a mixture of shredded memory foam and polyester fibers to create cushions. In some embodiments, central headrest 10 may be filled with at least one block of memory foam. Filling may be inserted through the end or ends and then the compartments sealed, as by sewing, stitching, gluing, or the like, as is known in the art of pillow-making.

Referring to FIGS. 1-5, the hybrid pillow 1 may be assembled from fabric structure 2, with fabric structure 2 being divided, preferably by elongated fabric walls, herein referred to as risers (left riser 121 and right riser 122) set along parallel sides of the central section adjacent and separating from the bolster sections. Risers are preferably fabric panels that can collapse or expand as needed, and may preferably be of the same material as fabric panels for the center and bolster sections. In the alternative, risers may be constructed from a material that is stiffer or less stiff than the other fabric panels, and/or may include reinforcement material(s) such as bars or reinforced fibers to enhance rigidity and memory shape. The risers may divide fabric structure 2 into multiple separate sections or compartments, which together form a single fabric structure 2. In a preferred embodiment, fabric structure 2 may be formed from top panel 3 and bottom panel 4, with each panel being identical in construction. In a preferred embodiment, the panels may be shaped as parallelograms. In an alternative embodiment, a sheet of fabric may be folded over to form the top and bottom sections. In a preferred embodiment, top panel 3 may be divided into three sections; top center headrest fabric panel 10*a*, top left bolster fabric panel 11*a*, and top right bolster fabric panel 12*a*. Analogously, bottom panel 4 may be similarly divided into bottom center headrest fabric panel 10*b*, bottom left bolster fabric panel 11*b*, and bottom right bolster fabric panel 12*b*. In a preferred embodiment, top panel 3 may be overlayed over and fixed to bottom panel 4, forming the exterior of fabric structure 2, preferably along long ends 6 and 7 of each bolster section 11 and 12. In an alternative embodiment, multiple sections may be joined to form fabric structure 2.

Referring to FIG. 5, the dimensions of the parallelogram 300 are shown. The front end 301 and back end 302 form parallel lines, while the left-side end 303 and right-side end 304 form parallel lines with one another. Risers 121 and 122 are set perpendicular to the frame at front end 301 and back end 302. The angle of the each of the bolsters may be of the same degree to make the filled bolster sections form conical shapes when filled to form approximate portions of cones, as in a frustums, potentially of the same greater cone, e.g. with the same angle as between left and right bolsters (herein, the tapered, angled, bolsters being near frustum shape, may be alternatively referred to as cones or conical). The degree of the cone taper may be offset by 5 degrees, or as much as ten degrees between large and small bolster cones. See also FIGS. 3-4, and 6 for filled cones in bolster sections. The cones/frustums are pointing in opposite direction with the larger end of each on opposite sides of the pillow.

In a preferred embodiment, top center headrest fabric panel 10*a* and bottom center headrest fabric panel 10*b* may be rectangular in shape. As most particularly seen in FIG. 5, dimensions of the preferred template for fabric structure 2 are shown. A seam or hem 48*a* is set around perimeter 48 with a set width of approximately one-quarter inch into the material, reducing the sections by such with as a seam allowance. In some adult-size hybrid pillow embodiments top center headrest panel 10*a* and bottom center headrest fabric panel 10*b* may have a width 15 of five inches (plus or minus half an inch) and a length 16 of twenty-seven and a half inches (plus or minus half an inch). In a preferred embodiment, when filled, (as discussed below), headrest 10 may have a depth of approximately two inches corresponding with the height of risers. Preferably both risers have the same height (and length). In some alternative embodiments, the length of top center headrest panel 10*a* and bottom center headrest panel 10*b* may include an approximately quarter-inch to half-inch edge used as a hem, and/or to close the fabric as seam allowance. In some embodiments, width 15 may be longer or shorter than five inches. In some embodiments, length 16 may be longer or shorter than twenty-seven and a half inches. In some embodiments, center headrest 10 may be rounded, or include a rounded pillow/foam insert with a bulging convex top. Any shape for headrest 10 or its filling may be used for the center section of the pillow. Preferably, headrest section has a flat shape when filled, and dimensions are approximately an inch in each direction. Top center headrest fabric 10*a* and bottom center headrest fabric 10*b* may be fixed to one another, forming the exterior of headrest 10, preferably via interceding risers 121 and 122. Headrest 10 may include top center headrest fabric panel 10*a*, bottom center headrest fabric panel 10*b*, left riser 121, right riser 122, and memory foam block 50 (shown in FIG. 9).

In some embodiments, top left bolster fabric panel 11*a* and bottom left bolster fabric panel 11*b* may be trapezoidal in shape. Left booster being the larger booster as between left and right. It is preferable that top left bolster fabric 11*a* be secured to bottom left bolster fabric 11*b* along left perimeter 45, forming a first side 11*c* of left bolster 11. A second side of left bolster 11, may be formed from top left bolster fabric 11*a* being joined to left riser top edge 40, and bottom left bolster fabric 11*b* being joined to left riser bottom edge 42. In a preferred embodiment, when left bolster section 11 is filled with filling, left bolster 111 is tapered at one end, sloped, and preferably conical in shape. It is preferable that left bolster 111 have a large, elevated left first end 20 and a second medium-sized, less elevated left second end 21 (as further discussed below). In some preferred embodiments, top left bolster fabric panel 11*a* and bottom left bolster fabric panel 11*b* may have a first left large end 20, with width 17 of approximately ten inches (plus or minus one inch). Top left bolster fabric panel 11*a* and bottom left bolster fabric panel 11*b* may have a second medium-sized left end 21 having a width 18*a* of approximately seven inches (plus or minus half an inch) (See FIG. 5).

In some embodiments, each of top right bolster fabric panel 12*a* and bottom right bolster fabric panel 12*b* may be trapezoidal in shape. Right booster being smaller than left booster. It is preferable that top right bolster fabric panel 12*a* be secured to bottom right bolster fabric panel 12*b* along right perimeter 47, forming a first side 12*c* of right bolster section 12. A second side of right bolster section 12, may be formed from top right bolster fabric panel 12*a* being joined to right riser top edge 41, and bottom right bolster fabric panel 12*b* being joined to right riser bottom edge 43. In a preferred embodiment, when right bolster section 12 is filled with filling, right bolster 112 may be tapered at one end, sloped, and preferably conical in shape. In a preferred embodiment, right bolster 112 may have a smaller, less elevated right first end 22, and a medium-sized, more elevated right second end 23 (as further discussed below). In an alternate embodiment, left second end 21 (as discussed above) and right second end 23 may be identical in width, both having an approximate width 18*a* and 18*b* of seven and three-quarter inches (plus or minus half an inch). Preferably the medium sized portion are eight and a half inches for the large end of the small bolster, and five and a half inches for the small end of the larger booster. In some embodiments, right first end 22 may be approximately seven inches (plus or minus half an inch). In such embodiments, fabric structure 2 may be a parallelogram having a total width of approximately twenty-one inches (plus or minus one inch), and a length of twenty-seven and a half inches. In such embodiments, the width may be a combination of the width 18*a* of left bolster panel 11, the width 15 of center headrest 10, and the width 18*b* of right bolster panel 12. (Each dimension throughout this disclosure is preferably understood as providing for the possibility of plus or minus one-half inch).

Note the twenty-one inch width is reduced by two seam allowances of a quarter inch each on the ends to form a value of seven inches plus five inches plus eight and a half inches for a total of twenty and a half inches plus the two quarter-inch seams on each side. In some embodiments, the width of twenty-one inches and the length of twenty-seven and a half inches does not include the stitching around perimeter 48 of fabric frame 2, which adds approximately a quarter inch to each side, as left perimeter 45, back perimeter 46, right perimeter 47, and front perimeter 49 may each have approximately a quarter to half an inch of hemming. In some embodiments, the hemming is included in the total width of twenty-one inches, and in the total length of twenty-seven and a half inches. In some embodiments, the hem may be sewn with a serger or overlock stitch.

As seen in FIG. 3, panel 3 and bottom panel 4 may each be fashioned from a single piece of fabric, such that top panel 3 and bottom panel 4 may be fixed to one another to form fabric structure 2. Panel 3 and panel 4 interior 35 (not shown) may be divided by fabric risers 121 and 122 such that top panel 3 and bottom panel 4 are each sectioned into right bolster fabric panels 12*a* and 12*b*, left bolster fabric panel 11*a* and 11*b*, and center headrest fabric panel 10*a* and 10. Each section may be formed from a riser, or other such divider, sewn into the space between panel 3 and panel 4. Long edges of perimeter 48 preferably being sewn together or formed together with one or both short ends of each compartment open for filling before being sealed closed.

As seen in FIG. 2, in a preferred embodiment, two risers, left riser 121 and right riser 122 may be sewn in-between top panel 3 and bottom panel 4, such that left riser 121 and right riser 122 are set in the interior space of fabric structure 2. In some embodiments, left riser 121 and right riser 122 may be, but are not necessarily, rectangular in shape. In a preferred embodiment left riser 121 may form first side 40 of left bolster 11, and right riser 122 may form first side 41 of right bolster 12. It is preferable that left riser 121 and right riser 122 run perpendicular to the end wall, and parallel to the length of left bolster section 11 and right bolster section 12; such that the risers 121 and 122 separate each bolster section 11 and 12 from headrest section 10. In a preferred embodiment, left riser 121 and right riser 122 may each be two inches wide, plus or minus half an inch, and twenty-seven and a half inches long, plus or minus half an inch. It is preferable that the length of left riser 121 and right riser 122 be analogous to the length of fabric structure 2.

In a preferred embodiment, left riser 121 and right riser 122 may be elongated fabric walls, that may be, but are not necessarily, rectangular in shape, with left riser 121 having left top edge 40, right top edge 41, left bottom edge 42, and right bottom edge 43. In a preferred embodiment, left top edge 40 and right top edge 41 will be sewn, or otherwise fixed, onto top panel 3 interior face 44, and left bottom edge 42 and right bottom edge 43 may be sewn, or otherwise fixed, onto bottom panel 4 interior face 44. It is preferable that the entire length of left top edge 40, right top edge 41, left bottom edge 42, and right bottom edge 43 be sewn onto or otherwise fixed to top panel 3 and bottom panel 4. With left riser 121 and right riser 122 spanning the length of top panel 3 and bottom panel 4, fabric frame 2 may be divided into three distinct, self-contained sections; left bolster section 11, right bolster section 12, and center headrest section 10. Left riser 121 and right riser 122 may also function to lift top panel 3 above bottom panel 4, such that fabric frame 2 may be a parallelepiped or other such three-dimensional prism. In some embodiments, left riser 121 and right riser 122 may be fabricated from the same fabric material as fabric frame 2.

As seen in FIG. 3, top panel 3 and bottom panel 4 may be joined to one another along perimeter 48. In some embodiments, perimeter 48 may have an overlocked edge of approximately a quarter inch to half an inch. In some embodiments, the width of perimeter 48 does not reduce the aforementioned widths and length of left bolster section 11, right bolster section 12, and central headrest 10. In some embodiments, top panel 3 may be fixed to bottom panel 4 along perimeter 48, with left perimeter 45, back perimeter 46, and right perimeter 47 being sewn or otherwise fixed, after which frame 2 may be filled, as described below. Once frame 2 is filled, front perimeter 49 may be sewn shut, securing the fill within frame 2.

As seen in FIG. 8, in a preferred embodiment, center headrest section 10 may be filled with a rectangular block of memory foam 50 to form a headrest 110. In some embodiments, the memory foam may be infused with a cooling gel as is known in the art of memory foam production. In a preferred embodiment, the rectangular block of memory foam 50 may be approximately five inches wide 51, twenty-five inches long 52, and two inches thick 53. In a preferred embodiment, the memory foam block may be inserted in frame 2 at the opening for center headrest 10, such that the length 52 of the memory foam block runs parallel to left riser 121 and right riser 122, with the width 53 running perpendicular to left riser 121 and right riser 122. In some embodiments, rectangular block 50 may include pointed wedge shape at the ends (54 and 55). A wedge shape may be cut out of front edge 54 and back edge 55, such that front edge 54 and back edge 55 can easily be fixed to fabric frame 2. In some embodiments, it is preferable that the wedge be cut out of front edge 54 and back edge 55 at an angle of approximately forty-five degrees, with the narrowest point of each edge being fixed to perimeter 48 of fabric frame 2, e.g. by sewing, glue, tacking, or otherwise known in the art of pillows and stuffed fabrics. In some embodiments back edge 55 may be coupled to back perimeter 46, preferably with stitching, and front edge 54 may be coupled to front perimeter 49, preferably with stitching. Thereby, securing memory foam 50 within center headrest 10, such that the central rectangular prism foam insert is less prone to bunching, warping, and twisting within its compartment during use.

In some embodiments, memory foam 50, may have a memory foam first side 80, such that memory foam first side 80 is adjacent to left riser 121, and a second side 81, such that memory foam second side 81 is adjacent to right riser 122. In such embodiments, memory foam 50 may be further secured within center headrest 10, via fastener 84. As seen in FIG. 9, fastener 84 may pass through left riser 121, memory foam first side 80, memory form second side 81, and right riser 122, such that memory foam 50 is fixed to both left riser 121 and right riser 122 via fastener 84. Fastener 84 may be but is not necessarily five inches in length. It is preferable that the length of fastener 84 correspond to the width of memory foam 50. In some embodiments, fastener 84 may be, but is not necessarily the "Avery Dennison 08961-0 Paddle Fastener". In some embodiments, a single fastener 84 may pass through memory foam center 85. In other embodiments, fastener 84 may pass through any section of memory foam 50. In some embodiments, a plurality of fasteners 84 may fasten memory foam 50 to left riser 121 and right riser 122. In a preferred embodiment, a plurality of evenly spaced fasteners may pass through left riser 121, memory foam 50, and right riser 122.

In a preferred embodiment, left bolster section 11 and right bolster section 12 may be filled with a mixture of polyester fibers and shredded memory foam. In some embodiments, the shredded memory foam may be infused with a cooling gel. Other fillings may also be suitable for left bolster section 11 and right bolster section 12. In some embodiments, left bolster section 11 and right bolster section 12 may be filled with a mixture composed of approximately eighty percent shredded memory foam and approximately twenty percent polyester fibers. In some embodiments, the memory foam may be shredded into pieces ranging from an eighth of a cubic inch to two cubic inches. In some embodiments, pieces may be smaller and/or larger. A fill composed of approximately eighty percent shredded memory foam and approximately twenty percent polyester fibers may provide optimal structural support, spring, comfort, and resilience.

In some embodiments, left bolster section 11, having a "large" first end 20 and a "medium" sized second end may be filled with the aforementioned memory foam/polyester fiber composite. In some embodiments, it is preferable that left bolster section 11 be filled with one point two pounds of the memory foam/polyester fiber composite filling. Right bolster section 12, having a "small" right first end 22 and a "medium" right second end 23, may also be filled with the memory foam/polyester composite, but because right bolster 112 is smaller than left bolster 111, right bolster section 12 may only require approximately zero point nine pounds of the memory foam/polyester composite filling. After filling, left bolster 111 and right bolster 112 are preferably rounded supports that feature a sloped surface, such that the bolsters are conical or frustrum in shape. In a preferred embodiment, left bolster 111 large first end 20 may have a height of four and three-quarter inches. In some embodiments, particularly in embodiments designed for children, the height may be lower. In other embodiments, the height may be larger. In a preferred embodiment, the incline will decrease from left bolster 111 large first end 20 to left bolster "medium" second end 21, with, in some embodiments, "medium" left bolster second end 21 having a height of approximately four and a quarter inches. In alternative embodiments, the height of left bolster second end 21 may be larger or smaller, particularly in embodiments designed for children. It is important to note that, throughout the present disclosure, the designation of "right" and "left" are solely used to provide clarity and distinguish between the two sides of fabric frame 2, but embodiments in which the dimensions and fills of "left" bolster 11 and "right" bolster 12 are switched also fall within the scope of this disclosure.

Right bolster 112 may be similarly sloped, with, in some embodiments, "small" right first end 22 having a height of three and a quarter inches, and "medium" right second end 23 having a height of four and a quarter inches. In alternative embodiments "small" right first end 22 and "medium" right second end 23 may have smaller or larger heights. Particularly, in embodiments designed for children, the heights may decrease, sometimes proportionally. In other embodiments, the heights, in a single or both bolsters 111 and 112 may increase. In alternative embodiments, the heights in one or both bolsters may increase on one end and decrease on another. Some heights may be increased while others are decreased. The present disclosure includes any and all bolster heights and slopes.

The height difference between left bolster's 111 large first end 20 and medium second end 21, as well as the height difference between right bolster 111's small end 22 and medium second end 23 respectively, create sloped bolsters, allowing pillow users to select any pillow height within the range of heights between first right small end 22 and large left end 20. Thereby producing a single pillow that can accommodate various sleeping positions, and various body types and sizes. The presently disclosed pillow can accommodate both those requiring low pillows for sleeping in a supine position, those who prefer pillows for lateral sleeping; and anyone needing any size in between.

A booster 93 may be used to elevate an existing pillow, and support the pillow 1 set above booster cushion to lengthen the useful life of the (upper) pillow and change the ergonomic function of the pillow and its performance. Compressing the pillow compresses the filling of can significantly alter the firmness and performance of pillows, especially those that incorporate a loose filling. A booster lessens load on pillow and thus can enhance or increase useful life of pillow.

In some embodiments, the pillow may be encased in an appropriately sized standard pillowcase (as seen in FIG. 12). In other, preferred embodiments, as seen in FIG. 11, the pillow may be encased in booster unit 90. Booster unit 90 may be a dual-compartment fabric enclosure, with a first top compartment 91 being large enough to accommodate pillow 1, and a second bottom compartment 92 having space for foam booster 93, such that foam booster 93 may be inserted into the bottom compartment 92 to raise pillow 1, without impacting the softness, feel, and function of pillow 1. In some embodiments, second bottom compartment 92 may include a zippered opening 94, such that various-sized boosters 93 may be interchangeably inserted into bottom compartment 92. In some embodiments, second compartment 92 may be large enough to accommodate a plurality of boosters.

For sanitary and product maintenance purposes, pillowcases are often installed to protect the pillow and allow a sleeping surface to be cleaned consistently. As pillow cases are sized mostly longer or shorter and geared to match the different widths of each individual pillow size. A new pillow case may be necessary to accommodate the pillow below and/or used with an additional component to allow for additional lift. To increase lift or height, more volume may be provided to lift via a pillow support structure.

Preferably, there are two parts to the cushion booster 93, the booster cushion booster unit 90, being a generally planar body, and a pillowcase (either substituting and improving fabric frame 2, or in addition to fabric frame 2) that includes two adjacent compartments top compartment 901 and bottom compartment 902 to allow a top compartment 901 to house the pillow 1 and a lower compartment 902 to house a booster cushion 93. Preferably, the booster is half and inch in height to four inches in height, with a preference for a one and a half to two inch booster height.

A booster cushion may be comprised of any material that allows for partial or full lift (or elevation) of the pillow in the upper compartment. For example, a booster cushion may include foam that is preferably size in accord with the upper pillow to mimic or correlate with the footprint thereof. A user configuration may include the booster cushion being on the bottom (optionally coupled to pillow 1 as being in lower compartment 902) elevating the pillow (optionally in an upper compartment 903, adjacent thereto), creating a hybrid pillow-plus-cushion retaining the standard, expected feel, shape, and comfort of the pillow at a higher position. Each booster may be covered with the same white fabric used for the pillow envelope, to protect the booster. The booster is preferably sewn together on all sides or ends.

The dual-compartment pillow case may be built from three pieces of fabric. Top two pieces may be the same or similar size as those used for a single pillow (as described above), while a third sheet may be adhered along up to three ends to provide a lower compartment to house the booster.

Method of Use

The presently disclosed pillow may replace a standard sleeping or resting pillow. Users may choose to rest on any location on the pillow to achieve the desired height, support, and comfort. When laying on their backs, in a supine position, users may choose to position the backs of their heads on the center headbed with the selected bolster under their neck and shoulder area. When laying laterally, users may select a more inclined region of the bolsters to better support the neck region. Users who prefer sleeping in a prone position may choose a less elevated region of the bolsters, thereby resting their heads on the headbed, without excess bulk in the throat/neck region. Users who change sleep positions at night can easily reorient the disclosed pillow, without needing to disturb their restfulness and find an alternative, more comfortable pillow to accommodate the alternated position.

I claim:

1. A three-sectioned pillow comprising:

three sections comprising a flat central headrest section, said flat central headrest section bordered on a first side by a first rounded side section, and on a second side, opposite said first side, by a second rounded side section;

wherein the flat central headrest section comprises a central rectangular prism;

wherein the pillow comprises a pair of risers as elongated fabric walls, a first riser set along the first side between and adjacent the flat central headrest section and the first rounded side section, and a second riser set between and adjacent the second side between and adjacent the flat central headrest section and the second rounded side section;

wherein said central headrest section comprises a fastener set through at least one of the risers and into the central rectangular prism to secure the position of the central rectangular prism relative the three-sectioned pillow.

2. The three-sectioned pillow of claim 1, wherein the central rectangular prism comprises at least one wedged end affixed to a casing of the three-sectioned pillow.

3. The three-sectioned pillow of claim 1, wherein the two rounded side sections are filled with a shredded loose material.

4. The three-sectioned pillow of claim 3, wherein the two rounded side sections are filled with eighty percent shredded memory foam, plus or minus five percent, and twenty percent polyester fibers, plus or minus five percent.

5. The three-sectioned pillow of claim 1, wherein the two first and second side sections are conical in shape.

6. The three-sectioned pillow of claim 5, wherein the first side section is sloped, having a less elevated end with a first smaller diameter and a more elevated end with a first larger diameter.

7. The three-sectioned pillow of claim 6, wherein the second first side section is sloped, having a second less elevated end with a second smaller diameter which is larger than the first smaller diameter and smaller than or equal to the first larger diameter, and a second more elevated end with a second large diameter which is larger than the first larger diameter.

8. The three-sectioned pillow of claim 6, wherein the second first side section is sloped, having a second less elevated end with a second smaller diameter which is within one half inch of the first smaller diameter, and a second more elevated end with a second large diameter which is larger than the first larger diameter.

9. A parallelogram fabric pillow template comprising:

a frame, wherein the parallelogram fabric pillow template is comprised of at least three compartments separated by two interior vertical fabric risers;

a central section formed within, said central section comprising a pair of identically-shaped rectangular panels coupled as risers on opposing sides of the central section, the pair of rectangular panels separating the central section from a first end section and a second end section by said risers;

wherein the first end section comprises a pair of identically-shaped first trapezoidal panels and the second end section comprises a pair of other identically-shaped second trapezoidal panels;

wherein the pair of identically-shaped first trapezoidal panels have a first smaller end and a first larger end, wherein the first smaller end faces opposite the first larger end, and wherein the second end section has a second larger end and a second smaller end, such that the second larger end faces opposite the second smaller end; and wherein the first larger end is equal in length to the second smaller end.

10. A three-sectioned pillow comprising;

an elongated central section, said elongated central section comprising two opposing short ends and a first long end opposing a second long end, said elongated central section set adjacent a first rounded side section along the first long end, and a second rounded side section along the second long end;

wherein said first rounded side section comprises a portion of a conical shape with a first large end and a first small end, and said second rounded side section comprises a portion of a conical shape with a second large end and a second small end;

wherein the first small end is of the same diameter as the second large end.

11. The three sectioned pillow of claim 10, being encased in an at least dual compartmented fabric pillow case, said pillow case comprising a top pillow pocket housing said three-sectioned pillow set above and adjacent to a lower booster pocket housing a booster.

* * * * *